US007344023B2

(12) United States Patent
Painsith et al.

(10) Patent No.: US 7,344,023 B2
(45) Date of Patent: Mar. 18, 2008

(54) TRANSPARENT OPERATIONAL TOOLS CARRIER

(75) Inventors: Hermann Painsith, Klagenfurt (AT); Carl Elsener, Ibach (CH)

(73) Assignee: Victorinox AG, Ibach-Schwyz (CH)

( * ) Notice: Subject to any disclaimer, the term of this patent is extended or adjusted under 35 U.S.C. 154(b) by 0 days.

(21) Appl. No.: 11/331,557

(22) Filed: Jan. 13, 2006

(65) Prior Publication Data

US 2006/0112493 A1 Jun. 1, 2006

Related U.S. Application Data

(60) Division of application No. 10/159,985, filed on Jun. 3, 2002, now Pat. No. 7,036,174, which is a continuation of application No. PCT/AT99/00316, filed on Dec. 30, 1999.

(30) Foreign Application Priority Data

Feb. 12, 1999 (AT) ..... 2034/99

(51) Int. Cl.
*B65D 69/00* (2006.01)

(52) U.S. Cl. ..... 206/234; 206/37; 206/373

(58) Field of Classification Search ..... 206/37, 206/38, 38.1, 234–235, 349, 372–373
See application file for complete search history.

(56) References Cited

U.S. PATENT DOCUMENTS 2,630,212 A * 3/1953 Mosch ..... 206/234
4,758,452 A * 7/1988 Jakobsen et al. ..... 428/36.92
5,467,871 A * 11/1995 DeField ..... 206/38.1
5,893,483 A * 4/1999 Duran ..... 206/38.1
6,009,584 A * 1/2000 Padden ..... 7/170
6,044,967 A * 4/2000 Painsith ..... 206/234
6,076,665 A * 6/2000 Chuang ..... 206/234
6,145,994 A * 11/2000 Ng ..... 206/234
6,257,405 B1 * 7/2001 Painsith ..... 206/234
6,419,158 B2 * 7/2002 Hooglander ..... 206/37
2003/0038043 A1 * 2/2003 Painsith ..... 206/234

* cited by examiner

*Primary Examiner*—Bryon P Gehman
(74) *Attorney, Agent, or Firm*—Edwards Angell Palmer & Dodge; Philip T. Shannon

(57) ABSTRACT

An operational tools carrier, such as a pocketknife or a tool card, having a portion formed from a transparent or translucent material has been found to have various functional benefits in addition to the clear ornamental effects of transparency/translucenary. A pocketknife typically has a retaining body or frame in which tools can be stored. The frame has two side walls that lie opposite each other and that have been separated from each other by means of narrow side faces and front faces. A scale is provided on at least one of the side walls typically has retaining areas for removably holding operational tools, e.g., tools, knives, scissors. The side wall or scale forming the side wall is transparent in at least one partial area. A flat tool card formed from two plates coupled together to form a retaining are therebetween for strong flat tools thereon. At least a portion of at least one of the plates forming the tool card is transparent or translucent.

5 Claims, 7 Drawing Sheets

TRANSPARENT OPERATIONAL TOOLS CARRIER

CROSS REFERENCE TO RELATED APPLICATIONS

The present application is a divisional application of application Ser. No. 10/159,985, filed on Jun. 3, 2002, now U.S. Pat. No. 7,036,174 which is a continuation of the U.S. National Stage designation of co-pending International Patent Application No. PCT/AT1999/00316 filed on Dec. 30, 1999, which claims priority to Austrian Patent Application A 2034/99 filed Dec. 2, 1999. The entire content of each of the above applications is expressly incorporated herein by reference thereto.

FIELD OF THE INVENTION

The present invention relates to an operational tools carrier. More particularly, the present invention relates to improvements to the housing of an operational tools carrier.

BACKGROUND OF THE INVENTION

Different operational tools carriers with variously designed retention bodies for accepting one or several layers of operational tools, such as pocket tools or tool cards, for example, are known in the art. However, such traditional operational tools carriers do not meet all the requirements placed on them.

For example, U.S. Pat. No. 3,851,986 describes a pocket knife consisting of a base unit equipped with cover plates. Provided on the base unit, facing the first cover plate and disposed in a plane extending parallel to the first cover plate are a series of separated compartments designed to accept functional elements such as a compass, fish hooks etc. Facing the other cover plate and separated from the compartments is an additional slot into which a knife blade can be retracted. One of the cover plates is transparent and detachably screwed to the base unit. The drawback of this earlier pocket knife design lies in the fact that when the functional components are ready to be used, they must be removed from the compartment in which each functional component is stored loosely. Thus, it is first necessary to unscrew the entire cover plate, then the functional component's compartment can be accessed for removal of the functional component from the compartment. Therefore, quick removal of the needed functional components from the knife is not possible since there is a disassembly process, and, since they functional components are stored loosely in the compartments, there is a chance that the functional components could get tangled in the compartment.

WO Publication 99/56918 A1 and U.S. Pat. No. 4,854,045 both describe a pocket knife with an LCD display integrated into the cover plate. The knife includes a holder with two mutually facing side panels each of which has a cover plate fastened in a fixed fashion thereto. The cover plate is provided with a recess which accepts the LCD display. The area surrounding the LCD display is opaque rather than transparent. The drawback here is that much of the area of the cover plate is taken up by the fixed LCD display, prohibiting the storage of other functional elements in the cover plate.

Another example of prior art that has a drawback is British Patent No. 2,051,009. This patent describes a drill-bit cartridge which features storage blocks with two parallel, directly neighboring, rows of consecutive nests for drill bits.

Along one lateral surface, the storage nests are provided with access openings which can be closed off by means of a sliding shutter that rolls over the lateral surface between the ridges extending along the edge of the storage unit. The shutter-like closure is provided, in a direction perpendicular to the movement of the closure, with two mutually distant openings which in a particular relative position line up with the access opening of the storage block, permitting the removal of the selected drill bit from the cartridge. By virtue of the design of this drill-bit cartridge, i.e., of the predetermined relative position of the opening in the shutter and, respectively, of the access opening in the storage block, it is possible to remove only one drill bit at any one time. While the access opening for one drill bit is released, allowing the removal of one drill bit, the other access openings are blocked by the shutter, preventing the removal of another drill bit from another storage nest. The drawback, however, of this design lies in the bulk of the block-shaped storage unit and the associated, correspondingly costly amount of material involved.

Various plastics materials are known. For example, U.S. Pat. No. 5,079,851 describes a tape measure with two mutually facing housing half sections. One of the two sections features a writable surface. The writable surface consists of a transparent plastic material, covering a decorative panel between the housing section and the transparent plate. U.S. Pat. No. 4,943,406 describes a method for producing heat-resisting containers from laminated plates. The laminate consists of an amorphous polymer such as polyethylene terepthalate. However, such materials have never been applied more broadly to the operational tools carrier art in any manner prior to the present invention.

A well known form of an operational tools carrier is a pocket tool, such as a pocket knife. Typical pocket tools are formed by layering a plurality of substantially flat tools (e.g., blades, saws, files, a cap lifter, a bottle opener, a lanyard, etc.) and spacer plates in a sandwich. An outer layer, known as a "scale," on either side of the tool provides a grasping surface for the pocket tool and forms a part of the exterior housing. Tool cards, which are a newer form of an operational tools carrier, such as disclosed in U.S. Pat. No. 6,044,967 to Painsith, have a substantially flat, card-shaped carrier or housing formed from a pair of plates spaced apart to provide a planar space or compartment therebetween in which substantially flat tools may be stored.

Both the scales of pocket tools and the plates of tool cards have heretofore been formed from a substantially opaque durable material. For instance, pocket tool scales may be formed from any desired material, such as metal, wood, plastics, thermoplastics, or nylon. Therefore, any written material, such as words, logos, or other indicia, must be provided on the exterior surface of the scales or plates, such as by printing or embossing, or other known methods. However, because the written material is only on an exterior surface, it is vulnerable to being worn away if it is not inlaid into the material of the scale or plate. Although inlays are longer lasting, they are also significantly more expensive than a more superficial application of written material to the exterior of the scale or plate.

Another disadvantage of the use of an opaque material for a scale is that objects stored in interior compartments in the scale (e.g., "scale tools" such as a toothpick, a pen, or tweezers) are not readily identifiable, since typically only a small grasping portion extends to a visible, accessible position. Thus, unless the user is very familiar with the location or other identifying aspects of the tool stored in the scale, the user must grasp the grasping portion of a tool and partially extend the tool from its respective storage compartment in order to determine if the desired tool has been selected.

A similar disadvantage occurs with the use of an opaque material for the plate of a tool card. As with the scale tools, the tools in the tool card typically only have a small grasping portion extending to a visible, accessible position. Thus, unless the user is very familiar with the location or other identifying aspects of the tools stored in the tool card, the user must grasp the grasping portion of a tool and partially extend the tool from its respective storage compartment in order to determine if the desired tool has been selected.

Likewise, it is desirable to determine if a particular storage compartment is the one designated for a particular operational tool to be inserted therein. In various instances, if an operational tool is inserted into an improperly sized or configured storage compartment, either the tool or the compartment or both may be damaged.

SUMMARY OF THE INVENTION

In accordance with the principles of the present invention, an operational tools carrier is provided with several additional functions, besides that of holding its operational tools. In particular, at least a portion of a housing component of an operational tools carrier is formed from a transparent or translucent (hereinafter "transparent" for the sake of simplicity and not limitation) material.

The present invention has the advantage of providing a permanent, precise advertising surface in a surprisingly simple way, because written material is placed in the inside the transparent material where it is protected by the transparent material's exterior surface. In addition, operational tools carriers widely used in commercial businesses can be produced in large numbers of units for stocking and then later outfitted with the required commercial printing format, depending on customer preferences, just before being delivered to the customer. The advertising matter for the operational tools carrier can be inserted in the form of an information carrier through the transparently designed scale and into its inside space, and then viewed through the scale. As a result, it is not necessary to use the most precise printing processes to affix the most diverse prints to the exterior of operational tools carrier housings that, for the most part, are made of highly stressed materials which are hard to print on, such as plastics. If the housing has a colorless transparent section, even several different color combinations can be used for the written material, such as advertising matter and promotional pictures or illustrations, to be provided. Furthermore, it is also possible to provide a housing which is transparent yet which is multicolored.

Another advantage of the present invention is that the operational tools stored in the operational tools carrier can be recognized precisely and accurately from the outside through the transparent portion of the housing. The user can thus avoid mistakenly extending the wrong operational tool. Likewise, it is readily apparent through the transparent portion of the housing if a given compartment is or is not appropriate for accepting a given operational tool. Thus, the user can avoid inserting an operational tool into the wrong storage compartment, thereby avoiding premature damage of the carrier associated therewith.

Moreover, assembly tolerances or the proper connection of housing components can be easily examined through their at least partially transparent construction. As a result, assembly is simplified and production rates may accordingly be increased.

The composition of the polymers used to form the transparent housing (or portion thereof) preferably gives the housing a high degree of rigidity and hardness. Because of the resulting high degree of abrasion resistance, wear and tear of the operational tools carrier can be kept to a minimum.

An additional, unexpected advantage of the provision of an operational tools carrier housing with a transparent portion is that at least some of the transparent materials which may be used are good thermal conductors. Thus, higher temperatures, intensive insulation, etc., pass through the transparent portion and directly affect materials that, compared with the housing, are for the most part more stable and resistant. This serves to extend the service life of operational tools carrier housing.

As a result of various of the above benefits, operational tools carriers with a transparent portion have a longer service life with increased serviceability, combined with reduced time in storage in a warehouse because of the greater flexibility of design and construction as well as customizing. Accordingly, the operational tools carriers of the present invention can be more readily adapted to individual customer preferences than those operational tools carriers without at least one of the unique features of the present invention.

Another advantage of the present invention, particularly with the tool card, is that the storage nests are defined by a multiplicity of ribs extending across the inner surface between the base plate and the cover plate whereby, in surprising fashion, the combination of the ribbed configuration and a base plate and cover plate consisting of a transparent material ensures even in the event of considerable exposure to sunlight that the tool card between the base plate and the cover plate is subjected to only a small amount of transverse stress, thus preventing delamination. The thermal energy is not only absorbed within the tool card but it is also channeled by the base plate and the cover plate, along the ribs and through the tool card, to a substrate.

These and other features and advantages of the present invention will be readily apparent from the following detailed description of the invention, the scope of the invention being set out in the appended claims.

BRIEF DESCRIPTION OF THE DRAWINGS

The detailed description will be better understood in conjunction with the accompanying drawings, wherein like reference characters represent like elements, as follows.

DETAILED DESCRIPTION OF THE INVENTION

Figure 1:
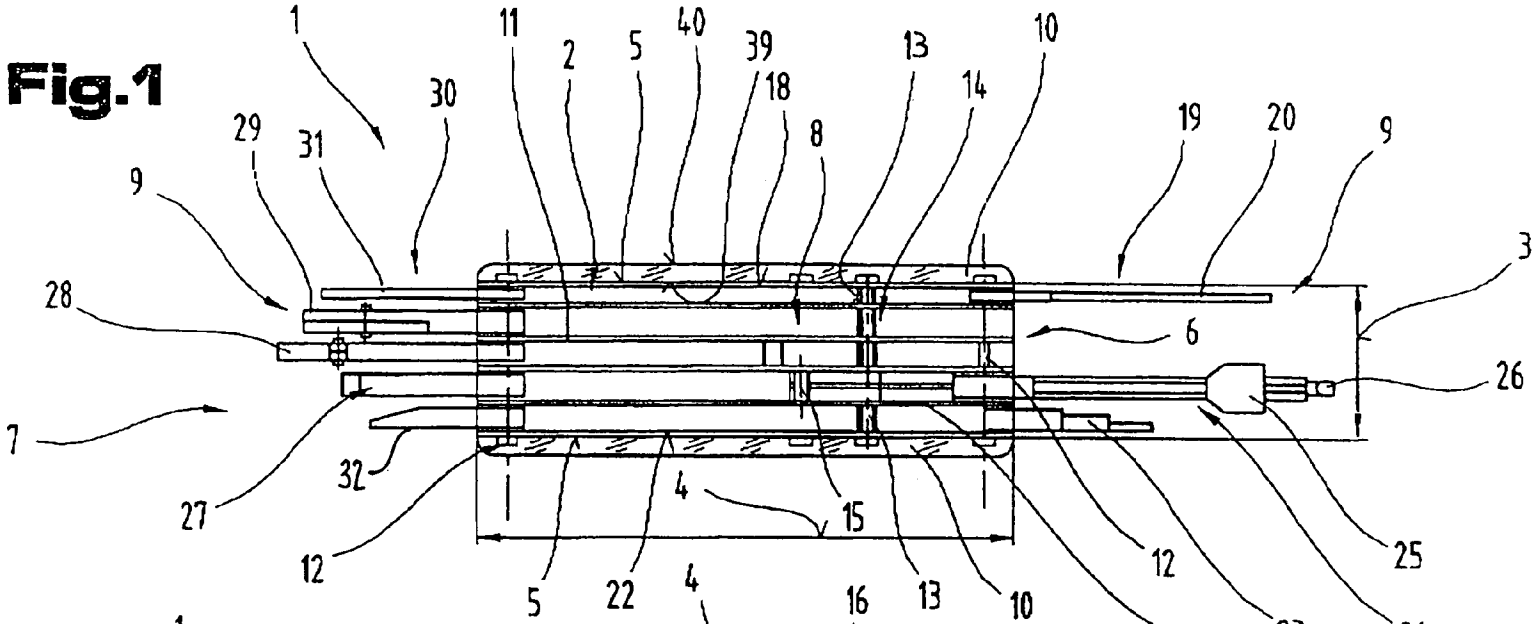
FIG. 1 is a top elevational view of an operational tools carrier, such as a pocketknife, with transparent scales made in accordance with the principles of the invention.

It is noted at the outset that similar parts have identical reference characters, or the same tool designators, in the variously described embodiments so that the disclosure contained in the general description of a part can be transferred, by way of analogy, to parts with the same reference character or tool designator. Similarly, positional information used in the description, such as, for example, top side, bottom side, at the side, and so forth, refer both to the Figure immediately being described and to its illustration, and must be transferred by way of analogy to the new position in the event of a change of position. In addition, individual characteristics or combinations of characteristics from the various exemplary embodiments, as illustrated and described, may represent or present in themselves independent and original solutions, or solutions in accordance with the invention.

Referring now to the drawings, FIGS. 1-4 show an exemplary operational tools carrier 1 in the form of a pocketknife. Tools carrier 1 has a retaining body 2 designed and constructed as a substantially rectangular-shaped retaining housing with preferably rounded ends and is made, for example, out of metal and/or plastic and/or metal and plastic. It will be appreciated that retaining body 2 may be in any other shape instead. Retaining body 2 has a width 3 and a length 4 measured at a right angle with respect to each other and a longitudinal axis L extending in the direction of length 4. Two longitudinal side faces 5 are spaced apart from each other in the direction of width 3 and run parallel to each other. Side faces 5 are perpendicular to end faces 6, 7 that are spaced apart from each other along length 4.

Operational tools 9, or other articles, are provided in interior retaining areas 8 which extend longitudinally between side faces 5 and end faces 6, 7. Retaining areas 8, constructed from retaining body 2, are separated from each other by means of dividing walls or spacer plates 11. Longitudinal side faces running on both sides faces 5 of retaining body 2 receive a preferably rectangular-shaped scale 10 with preferably rounded edges in at least the corner area. Scales 10 each function as a side wall and are respectively connected with retaining body 2.

A cross pin 12 is provided adjacent each of the two opposing end faces 6, 7 and extend along width 3 of retaining body 2 to couple the tools, spacer plates, and scales together in spaced relation along width 3 to form a modular-designed and constructed operational tools carrier 1 that accepts and retains operational tools 9. Operational tools 9 are pivotably coupled to and pivot about one of cross pins 12 approximately 180° from a storage position within retaining area 8 to an extended, working position outside retaining area 8.

An intermediate cross pin 13, positioned between the two cross pins 12 but closer to end face 6 than to end face 7. Intermediate cross pin 13 protrudes at least partially into a groove or channel in several of the resilient or springy support elements known in the art as locking springs provided to abut an operational tool 9 revolving around cross pin 12 to lock the operational tool 9 into one of the storage position, an intermediate position, or an extended working position, as known in the art. Intermediate cross pin 13 may also extend through at least some of the locking springs.

An additional intermediate cross pin 15, arranged parallel to cross pin 13 (positioned between intermediate cross pin 15 and end face 7), preferably supports most of the operational tools 9 located on narrow side face 16 of retaining body 2. At the same time, an additional operational tool 9 swiveling on bearings is accepted and retained on this cross pin 15 on a narrow side face 17 lying opposite narrow side face 16.

The operational tools 9 of exemplary operational tools carrier 1 will now be described with reference to FIGS. 1-4. A retaining area 8 adjacent to side wall 18 extends to receive and retain an operational tool 9 such as a knife with knife blade 20 being enclosed between side wall 18 and dividing walls 11. If desired, an additional knife handle (not shown) is placed so as to be recessed lengthwise in the blade over one part of the blade's length and rises at least partially over side wall 18 designed with height 21.

Additional operational tools may be provided as follows, with the understanding that modifications and substitutions are within the scope of the present invention. Side wall 22, mounted to lie opposite and parallel to side wall 18, and a dividing wall 11 running parallel to side wall 22, at least partially enclose another operational tool 9 within retaining area 8, such as a can opener 23. Retaining area 8, adjacent to retaining area 8 of can opener 23, extends to receive a tool holding device 24 forming an additional operational tool 9, which in its retracted position extends from end face 6 in the direction of end face 7. A preferably cylindrically constructed tool bit holder 25 is provided at the free end of tool holding device 24 to accept and to retain a selected tool bit 26. Tool holding device 24 and tool bit holder 25 are configured so that the tool bit 26 is held in place and cannot be bent. A tool storing device 27 running lengthwise within the same retaining area 8 in which tool holding device 24 is retained, and is coupled to an end of operational tools carrier 2 (end face 7) opposite the end at which tool holding device 24 is coupled (end face 6). Tool storing device 27 has several longitudinal slots, in which a tool bit 26 may be stored. Preferably, the slots extend transverse to the longitudinal extension of device 27, each slot being parallel to the other.

Three additional retaining areas 8 in the embodiment of FIGS. 1-4, run parallel to each other and to longitudinal side face 5 adjacent to the retaining area 8 in which tool storing device 27 is retained. These additional retaining areas are designed and constructed to accept additional operational tools 9, such as a combination pincer-pliers, a pair of scissors 29, and a knife 30 whose blade 31 in the retracted state extends into the same retaining area 8 as that of knife blade 20. Knife 30 is coupled to an end of operational tools carrier 2 (end face 7) opposite the end to which knife 19 is coupled (end face 6). Preferably, knife blade 31 is slightly smaller than the dimensions of blade 20 of knife 19. However, the reverse may be true. An operational tool 9 placed nearer to side wall 22, such as a wire-stripper 32 with a screwdriver formed at its end, preferably is arranged to lie opposite can opener 23 within retaining area 8.

Figure 3:
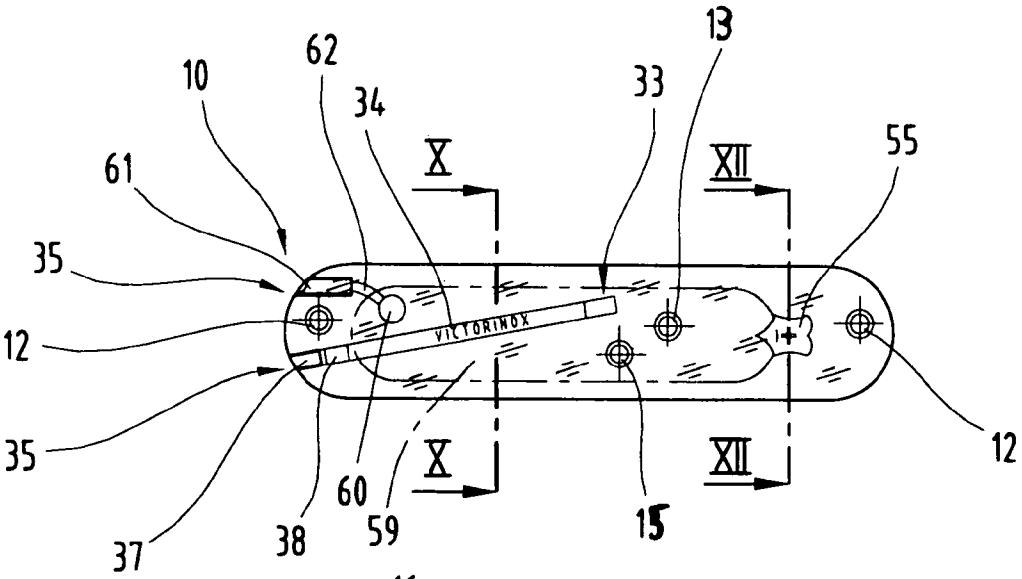
FIG. 3 is a second side elevational view of the pocketknife of FIG. 1.
Figure 4:
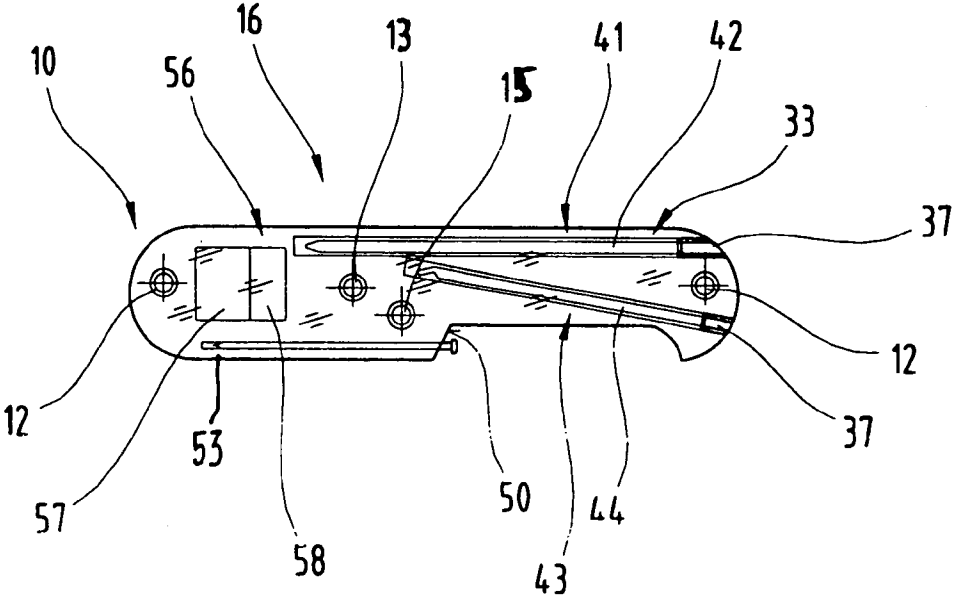
FIG. 4 is a side elevational view of another embodiment of a scale for an operational tools carrier in accordance with the invention.

As illustrated in FIGS. 3 and 4, at least one of scales 10, which are positioned on each side of retaining body 2 along longitudinal side faces 5, preferably is provided with at least one retaining area 33 for accepting and holding an operational tool 9. As shown in FIG. 3, first scale 10, mounted on side wall 18, preferably has at least one, somewhat rectangular longitudinal slot 34 which extends transverse to longitudinal axis L of retaining body 2 and forms retaining area 33. A preferably rectangular compartment opening 35 is provided in the border area of first scale 10 to provide access to the interior of retaining area 33. Retaining area 33 in first scale 10 preferably runs across the body of first scale 10 in the direction of cross pin 12, with opening 35 at end face 7 and retaining area 33 extending from end face 7 towards end face 6. However, it will be appreciated that other configurations are within the scope of the present invention. Operational tool 9 may be a pair of tweezers 34, for example, inserted through compartment opening 35 into retaining area 33. Operational tool 9 preferably has a somewhat L-shaped handle end 37 which rises in compartment opening 35. The handle end's cross-sectional measurements, at least over one section, are equal in size or larger than the cross-sectional shape of compartment opening 35 to facilitate grasping of handle end 37 to withdraw operational tool 9. In this embodiment, operational tool 9 is frictionally engaged in compartment opening 35 and/or in the area of longitudinal slot 34.

Of course, it also is possible to provide at least one protruding retention extension 38 in the area of handle end 37 and/or in the area of compartment opening 35 of scales 10. This extension, by way of example, protrudes out over a plane receiving its lengthwise extension and in a direction perpendicular thereto and holds operational tool 9 that has been inserted into scale 10 so that the tool has a positive fit. Handle end 37, held in compartment opening 35 between an inner surface 39 that runs congruent with longitudinal side face 5 and an exterior surface 40 of scale 10 separated from inner surface 39, exhibits a front face facing the base area of compartment opening 35 that has a somewhat conical expanding shape in the direction of outer surface 40.

Of course it also can be very functional to keep operational tool 9 in its inserted position by means of the surface roughness of longitudinal slot 34 and/or of operational tool 9 in a retention area that can include all of longitudinal slot 34. Of course, longitudinal slot 34 can be incorporated into side wall 18, 22 of retaining body 2 and/or in scale 10 and/or partially in side wall 18, 22 and in scale 10. This design construction forms a removal slot between the base of compartment opening 35 and handle end 37. This slot then makes it easier to access from the outside operational tools 9 that have been inserted into the border area of scale 10.

The second scale 10, on side wall 22, is shown in FIG. 4 as being outfitted with at least one retaining area 33 for accepting and retaining additional operational tools 9. This second scale 10 lies opposite and parallel to the first scale 10 on side wall 18. As shown in this exemplary embodiment, a longitudinal slot 41, for example, is provided in second scale 10 to narrow side face 16. Second scale 10 has a rectangular, spherical, etc., cross section and runs somewhat parallel to side face 5 formed from side wall 22. Side face 5 also is equipped in the border area with a compartment opening 35 for receiving and retaining the handle end of operational tool 9.

Longitudinal slot 41 in second scale 10 primarily serves to receive and to retain a ballpoint pen 42 held between side wall 18 and scale 10 by means of friction. In addition, longitudinal slot 41 can be curved so as to increase its retention force on ballpoint pen 42.

An additional longitudinal slot 43, adjacent to longitudinal slot 41, extends transverse to longitudinal axis L of retaining body 2 from end 6 towards longitudinal slot 41. Longitudinal slot 43 also is equipped in the border area of scale 10 with a compartment opening 35 for receiving and retaining handle end 37 of operational tool 9. In the exemplary embodiment, longitudinal slot 43 is rectangular-shaped and is preferably equipped with a toothpick 44.

Figure 2:
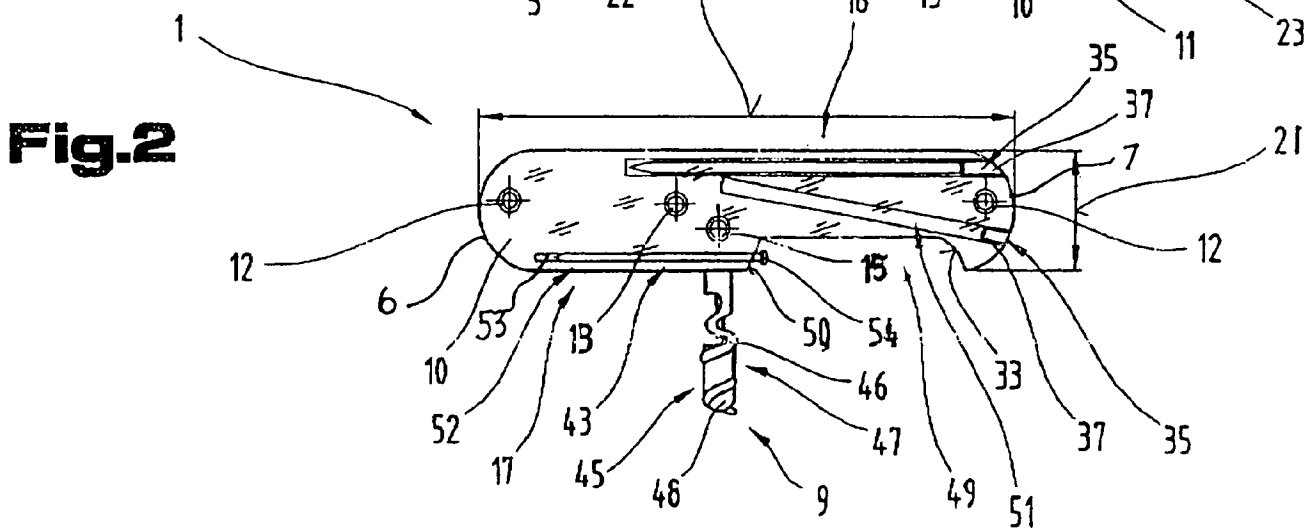
FIG. 2 is a first side elevational view of the pocketknife of FIG. 1, with an operational tool in an extended working position.

In addition to the above-described features, retaining body 2 includes between side walls 18 and 22 an additional operational tool 9 pivotably mounted on cross pin 15 along narrow side face 17 and lying opposite to the other operational tools 9. In the embodiment of FIG. 2, this tool is configured as a corkscrew 45. In particular, corkscrew 45 of FIG. 2 is shaped as a helix 46 carrying a small screwdriver 47 having a handle end 48 conformed to the up-grade slope of helix 46 and screwed into helix 46. Corkscrew 45, which can swivel on cross pin 15 about 90° from its storage position, has been placed in an area approximately half the length 4 of retaining body 2 and, in its extended state, preferably is positioned perpendicular to-longitudinal axis L of retaining body 2.

Second scale 10 and side wall 22, in particular, on narrow side face 17 of retaining body 2, are equipped, for example, with a trapezoid-shaped recess 49 extending over at least a portion of half of length 4 in the direction of narrow side face 16 over approximately one third of the height 21 of retaining body 2. Recess 49 has a side face 50 nearer to corkscrew 45 and which expands increasingly as it approaches the border area of scale 10, whereupon one side face 51 opposite the latter runs rounded so that the large cross section face arises in the border area of second scale 10. Furthermore, an additional longitudinal slot 53 for receiving and retaining a needle 52 is provided in second scale 10 with an opening in the area of side face 50, so that a needle head 54 rises above side face 50 when it is in a storage position inserted within slot 53.

Scales 10 are connected to side wall 18, 22 to be stationary, in which case, for example, scale 10 rises with the wall in the extensions that are distant from side wall 18, 22 and these extensions in turn correspond with boreholes located in scale 10 and form a force or press fit. Of course, scale 10 also can be connected with retaining body 2 using any state of the art fastener, such as, for example, gluing, screwing on, riveting, etc. It is useful if at least one of the two scales 10 is made of a transparent material in at least one section of its surface. Of course, however, if scales 10 are made of a different material, it also is possible for sub-sections of them to be opaque. This can be accomplished by sticking foil on, by roughening the surface or by some other process, or by applying a printing format. Of course, however, scales 10 may be constructed from several different plastic or synthetic materials that have these properties using injection molding. As an alternate embodiment, printing formats 55, especially graphic characters and/or font sets and/or graphical symbols, may be placed on scales 10. These printing formats or plastic foils with different properties, which also could be equipped with printing formats in turn, if preferred, can be provided on interior surface 39 and/or an exterior surface 40 and/or on longitudinal side faces 5 of scales 10.

Placing printing formats 55 on interior face 39 has proven to be especially advantageous, since they remain protected and hence undamaged from external effects such as abrasion, heating, shocks, and so forth, over the whole service life of the operational tools carrier 1.

As shown in the exemplary embodiment of FIG. 3, at least one print 55, such as, without limitation, a font set, etc., can be placed directly on inner face 39 of scale 10, and/or in scale 10, and/or on longitudinal side face 5 of side wall 18, 22. On the other hand, or in addition, one or several information carriers 56 can be arranged between side walls 18 and 22 and a respective scale 10 and/or within one or both of the two scales 10. An information signal 57 also can be inserted or intercalated into retaining areas 33 of scales 10 or between a scale 10 and a side wall 18, 22. The information signal, by way of example, can be operating instructions, safety instructions, printed advertising matter, date of manufacture, and the like.

Of course, inner face 39 and/or longitudinal side face 5 of side wall 18, 22 also can be used to form a design. Naturally, information carrier 56 and/or information signal 57 also can be formed by at least one memory and/or one computer chip 58 dedicated to operational tools carrier 1 that has been efficiently mounted in scales 10 and/or between exterior wall 18, 22 and inner face 39, and/or in a foil compound, to be further described below, and/or in exterior wall 18, 22. In addition, as shown in a greatly simplified way in broken lines in FIG. 3, at least one lighting device 60, and preferably one lighting device for each scale 10, may be incorporated as a source of light, preferably in a somewhat elongated-shaped hollow space 59 formed from scale 10. Lighting device 60 can be formed by a light-disseminating element such as, without limitation, a reflective layer, to enhance the intensity of the light emitted at inner face 39 of scale 10 and/or retaining body 2 and/or between inner face 39 and side wall 18, 22. At the same time, this design makes it possible to protect lighting device 60 against damaging effects. Lighting device 60 also acquires a substantially larger radiating surface because it preferably is actuated by means of a switch 61 placed in compartment opening 35. However, lighting device 60 also can be actuated by a switch integrated into scale 10 as foil membrane keys of a keyboard, for example, or the like, connected to lighting device 60 via connecting lines 62 shown in broken lines in the drawing. Of course, hollow space 59 can assume any desired geometric shape, such as, for example, the form of an ellipse, a rectangle, a spheroid, etc.

Currently available retaining bodies with lighting devices can only illuminate a small area since the lighting device does not have any additional reflector. However, by specially designing and constructing transparent scales 10, the heretofore unused body of scale 10 and/or of retaining body 2 and/or operational tools 9 can be used in an unexpected way to mount a reflecting layer that is radiated by the lighting device 60 and that propagates the light beam. A larger area can be illuminated in this way. Of course, the operational tools carrier 1 itself also can be illuminated from the inside, which makes it much easier to locate individual operational tools 9.

In another version of the embodiment of scale 10, a light beam falls on retaining body 2 through side wall 18, 22, and/or through a material between side wall 18, 22 and scale 10, and/or through scale 10 itself and/or through a foil compound, that by way of example, are made of a phosphorgen material—and of a phosphorescent and/or fluorescent, etc., material, in particular—that reflects that beam of light, and thereby greatly simplifies the task of locating the operational tools carrier 1 when it is lost.

A further embodiment variant (not shown in the drawings) of scale 10 and/or portions of retaining body 2 with retaining areas 8 formed by means of dividing walls 11, is provided with retaining areas 8 formed by a single and/or multiple layers of foil compound. The foil compound can be made from one or several protective layers and from one and/or several intermediate layers. The preferred layer is opposed to exterior side wall 18, 22, forms outer surface 40, and is made of a high-value material that can withstand the effects of weather, UV radiation, or mechanical stresses. Exemplary materials which may be used include PVC, PC, PMMA, PP, PET, PETR, MABS, PBT, SB, MBS or similar products. It is useful if the protective foil is highly scratch resistant and highly resistant to abrasion, and if it simultaneously exhibits the excellent permeability required to send a wireless transmission through the ether, for example, when using a computer and/or a memory chip. Of course, the intermediate layer can be made of a foil conducting material, a color coated foil, by a UV blocking coating, by a designer coating or by a designer coating containing the printing format 55, for example. Any desired variation of individual coatings is of course possible, each of which may be adapted to the purpose of the given application and individual customer tastes. Naturally, any state of the art foil compounds can be used.

Of course, an intermediate layer that already has a memory and/or computer chip incorporated therein can be applied and be joined with the protective or covering coatings. In this connection, it is especially advantageous if the computer and/or memory chips 58 can be specifically tailored to individual customer preferences. Of course, these computer or memory chips could be outfitted with the most varied operational capabilities, such as, for example, to serve as an automatic bank card, a pre-paid telephone calling card, a customer card, identity card, access control systems, membership cards etc. In this way, the memory and/or computer chip can perform a broad range of computer and memory operations to be executed.

Of course, at least partially reinforcing materials made, for example, from the most diverse plastics can be inserted between individual layers of the folio compound or on one or both surfaces of the folio compound, and be connected with them by being molded and/or rear injection or being stamped (embossed).

Figures 5, 6:
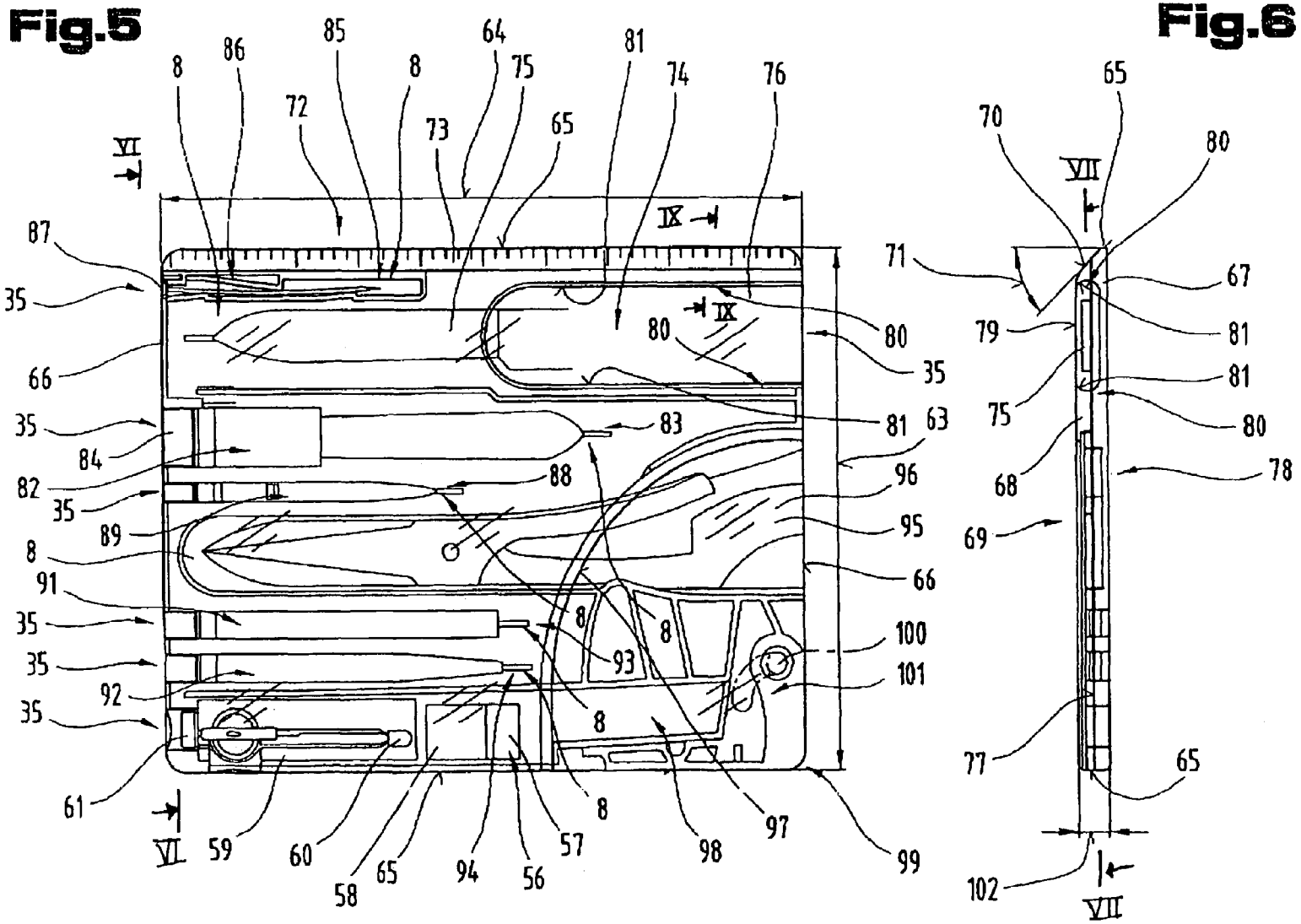
FIG. 5 is a top plan view of another operational tools carrier, in the form of a tool card, with a transparent scale in accordance with the principles of the present invention, in a highly simplified diagrammatic section.
FIG. 6 is a side elevational view along line VI-VI of the operational tools carrier of FIG. 5.
Figure 7:
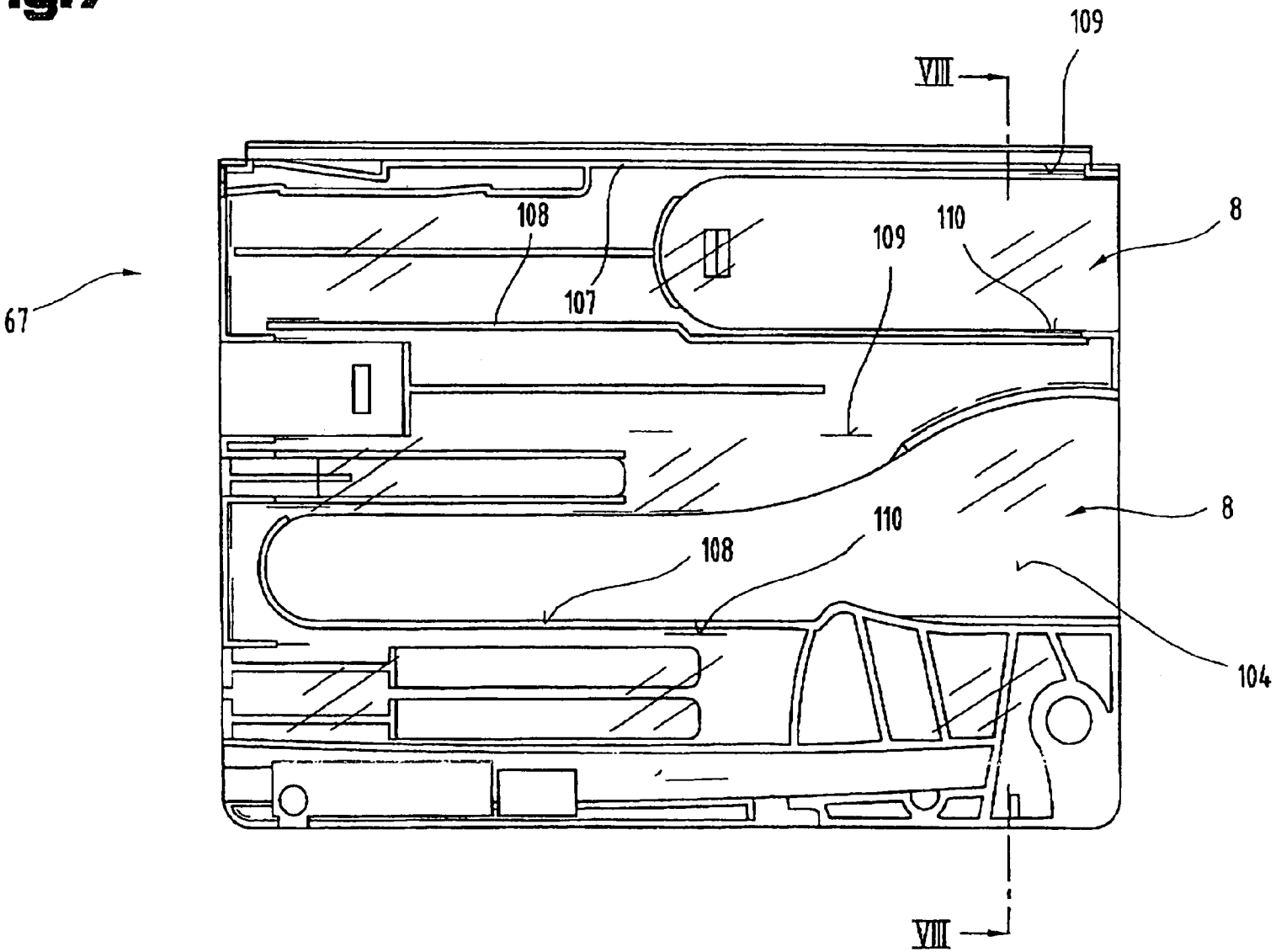
FIG. 7 is a cross-sectional view along line VII-VII of FIG. 6 showing a top plan view of the interior surface of the bottom plate of the operational tools carrier of FIG. 5.
Figure 8:
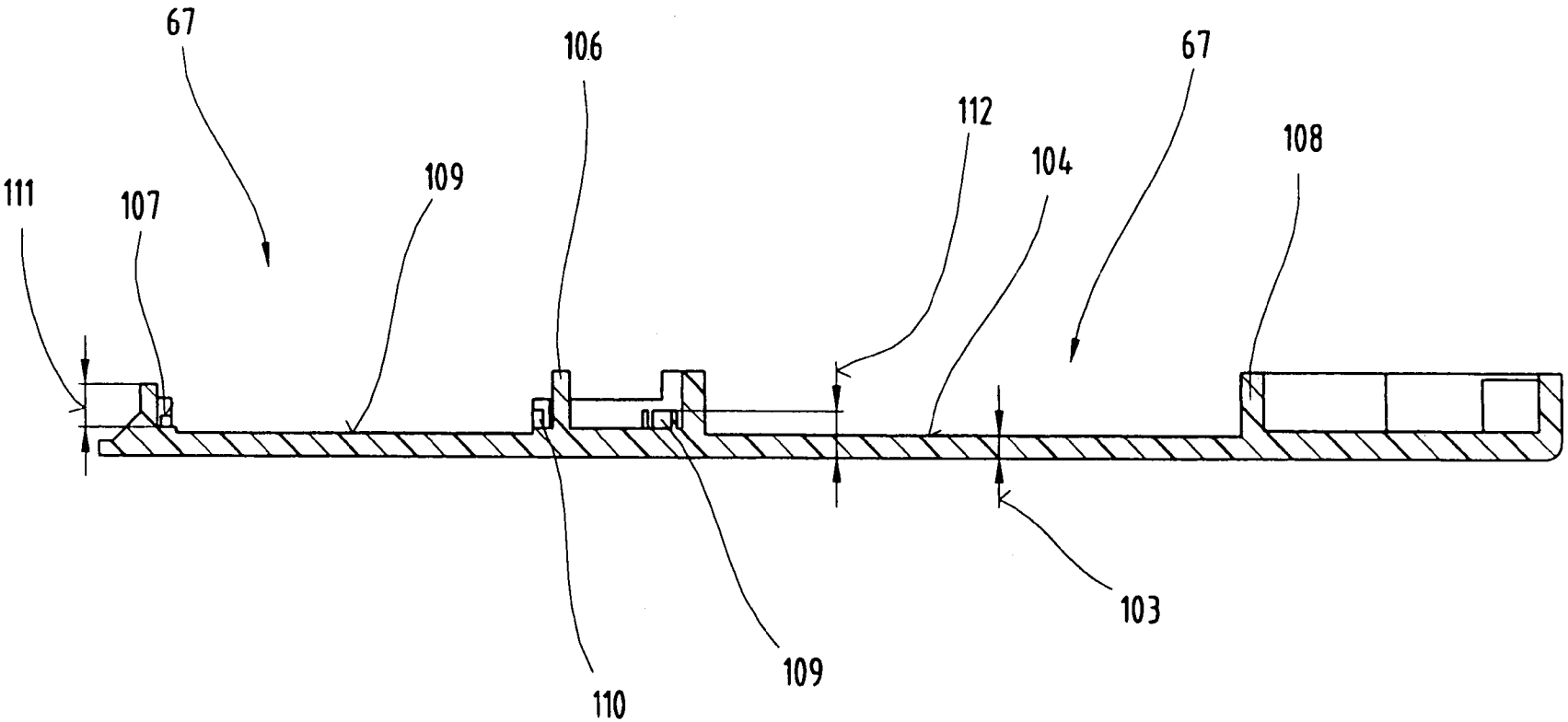
FIG. 8 is a cross sectional view along line VIII-VIII of the bottom plate of FIG. 7.
Figure 9:
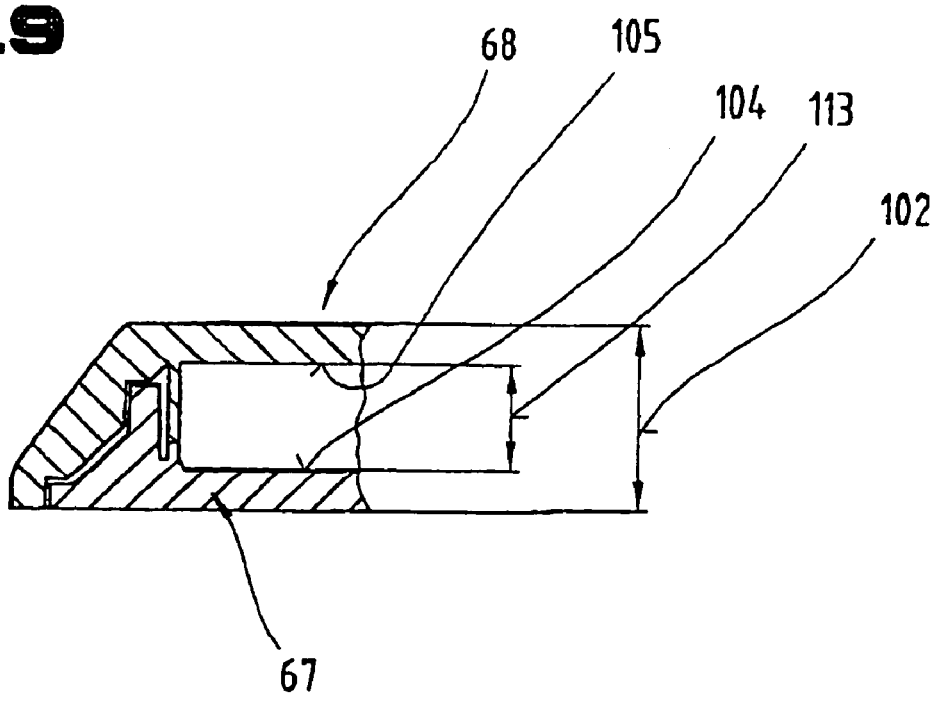
FIG. 9 is a cross-sectional view along line IX-IX of the operational tools carrier of FIG. 5.

FIGS. 5 and 6 show a one-piece and/or multi-piece, or complex operational tools carrier 1 suitable for a multi-piece tool card made of metal and/or of plastic and/or metal and plastic. Flat-shaped operational tools carrier 1 of FIGS. 5 and 6 has a substantially rectangular shape in plan view with a width 63 and a length 64 measured at right angles with respect to each other. Width 63 separates two longitudinal side faces 65 running parallel to each other and at a right angle to cross side faces 66 separated from each other by length 64. The flat-shaped operational tools carrier 1 of FIGS. 5 and 6 has a mounting plate 67 and a covering plate 68 that can be connected to each other so as to be separable or inseparable. The longitudinal side face 65 and cross side face 66 run, again preferably, at a right angle with respect to mounting plate 67 and to covering plate 68. Retaining areas 8 formed within flat-shaped operational tools carrier 1 extend out from opposed cross side faces 66. Operational tools 9 are held in retaining areas 8 in their inserted position.

The operational tools 9 to be stored within retaining areas 8 may include any of a variety of tools or articles of daily use, such as commonly provided in a flat operational tools carrier. Typically, operational tools 9 are flat tools which are completely removable from retaining areas 8. It will be appreciated that operational tools 9 described herein, including their positions, configurations, and orientations, are only exemplary, various modifications being within the scope of the invention.

Preferably, operational tools 9 are frictionally engaged within respective retaining areas 8 by any of a variety of frictional retaining means. For example, any or all of tools 9 may include a handle shaped and dimensioned to frictionally engage retaining areas 8 and/or the interior of retaining areas 8. If desired, the entire shape of area 8 may be configured to not match the shape of the tool to be inserted therein such that the mismatch results in a friction fit. For example, a bent retaining area may be provided to retain a straight object, such as a pin or pen, therein, the bend providing the necessary force against the object to retain the object in the retaining area. Alternatively, a portion of operational tool 9 (such as on a handle) and the interior of retaining area 8 may interengage via at least one detent and recess pair. Yet another manner of retaining operational tool 9 within retaining area 8 is by means of surface roughness of the interior of area 8 and/or of tool 9 in a retention area that can include the entire longitudinal extent of either or both. If desired, raised ribs or other mechanical retention means may be provided along the interior of retaining area 8 to provide a narrowed resilient gripping region to hold tool 9 firmly therein.

A longitudinal side face 65 is connected with an upper side 69 of covering plate 68 that runs at a right angle to it by means of a beveled side 70. Beveled side 70 tends to run from longitudinal side face 65 towards upper side 69 and the second longitudinal side face 65 at an inclined angle 71. However, even the second longitudinal side face 65 and/or cross side face 66, or at least portions of longitudinal side face 65 or of cross side face 66, may possibly have been arranged so as to slope toward mounting plate and/or covering plate 67 or 68, and to form a beveled side.

At the same time, beveled side 70 or an area of mounting plate 67 and/or covering plate 68 dedicated to it, exhibits a scaling 72, especially a length measuring stick 73. Retaining area 8 adjacent to beveled side 70 in FIG. 5 extends longitudinally to receive a knife 74 that constitutes an operational tool 9. Blade 75 of knife 74 is enclosed by mounting plate 67 and covering plate 68, and/or only by mounting plate 67 and/or only by covering plate 68, in a direction running approximately perpendicular to upper side 69. A knife handle 76 is given an opening 35 that rises above weldment area 77 of mounting plate 67 with covering plate 68 in the direction of a bottom side 78 of mounting plate 67. Knife handle 76 is opposite upper side 69 and runs parallel thereto, and is thus only circumscribed by mounting plate 67 in the direction of bottom side 78. In this way, retaining area 8 is enclosed for receiving and retaining an operational tool, i.e., for knife 74, by mounting plate 67 and, at least in terms of area, by covering plate 68 running parallel thereto. Knife handle 76 exhibits a gripping surface 79 that runs approximately parallel to and level with upper side 69.

Opening 35 which is formed from operational tools carrier 1, extends from the first cross side face 66 up to approximately half of length 64 of operational tools carrier 1. Two connecting link pathways 80 that run parallel to each other, and that preferably are oriented at a right angle to upper side 69, form the width of opening 35. Pathways 80 form a guide path 81 on one of the terminal areas closer to upper side 69 that rises above connecting link pathway 80 and in the direction of cross side face 66, and that holds operational tool 9.

A terminal area positioned closer to half the length 64 of operational tools carrier 1 and formed from opening 35 connects a rounding formed by the distance of the two connecting link pathways 80 to the parallel connecting link pathways 80. A preferably rectangular-shaped retaining area 8 running level with the base of covering plate 68 is incorporated in this rounding and receives and retains blade 75 of knife 74.

An additional retaining area 8 for a file 82, for example, is provided adjacent to knife 74 and has an opening 35 at an opposite end of longitudinal side face 65 along scaling 72. This retaining area 8 is enclosed by covering plate 68 and base plate 67 towards upper side 69 and bottom side 78, whereupon an approximately rectangular-shaped opening 35 for file 82, which can be introduced into retaining area 8, is provided on the second cross side face 66. A substantially rectangular longitudinal area or slot 83 is provided in covering plate 68 extending towards the opposite cross side face 66. File 82 is inserted into this longitudinal area 83. Handle end 84 of file 82 is received by opening 35, thereby permitting access to file 82 from the outside. Handle end 84 of operational tool 9 is formed like the handle ends described above and facilitates storage of operational tool 9 in its inserted position.

Another operational tool 9 is provided in operational tools carrier 1 in a direction opposite the direction of knife 74 and adjacent to scaling 72 and approximately in the area of beveled side 70. The operational tool 9 shown in FIG. 5 is in the form of a needle 86 that has been inserted into longitudinal area 85. Needle 86 can be introduced into longitudinal area 85 as needed via opening 35 in covering plate 68, whereupon a needle head 87 formed by the needle juts out in opening 35.

Adjacent to retaining area 8 of file 82 is an additional, similarly substantially rectangular retaining area 8 that receives an additional operational tool 9, in the form of a toothpick 89 in FIG. 5. Toothpick 89 can be inserted into longitudinal area 88 from the outside by means of opening 35.

Two additional retaining areas 8 run parallel to each other and to longitudinal side face 65 adjacent to retaining area 8 of toothpick 89. These two retaining areas serve to receive and to retain a pair of tweezers 91 and a ballpoint pen 92, respectively. In each case, these tools can be introduced into retaining area 8 via opening 35 of cross side face 66. A rectangular-shaped longitudinal area 93 designed to receive tweezers 91, and a longitudinal area 94 with a somewhat square cross section and designed to receive ballpoint pen 92, are preferably placed inside covering plate 68.

In addition, in the operational tools carrier of FIG. 5, there is an additional operational tool 9 between the retaining area 8 for ballpoint pen 92 and the longitudinal side face 65. This additional tool, in FIG. 5, is a lighting device 60 designed to be a source of light. Lighting device 60 is provided in a hollow space 59 and can be switched on by means of a switch 61 that can be actuated as needed. Hollow space 59, which is equipped with a light-reflecting element, is preferably designed so as to be rectangular, as shown in the diagram in FIG. 5. Switch 61 is preferably placed in a recessed opening 35 on cross side face 66 and thus can be actuated from outside. Of course, switch 61 also can be placed along longitudinal side face 65, and/or on mounting plate 67, and/or on covering plate 68, for example. Switch 61 may be made of any other form of entry key, of a touch contact surface, of a membrane (keypad) insert, or of a non-contact switch 61. Furthermore, as can be seen in FIG. 5, an insertion device for easily changing the battery in hollow space 59 is provided, for instance, in the corner area of hollow space 59 on longitudinal side face 65.

Retaining area 8, adjacent and opposite the retaining area for toothpick 89, extends for a pair of scissors 95. Scissors 95 extend from the first cross side face 66 towards the second cross side face 66. A scissors handle 96 of scissors 95 and a circular-shaped recess 97 of covering plate 68 are covered along upper side 69 by a swivel plate 98, whereupon opening 35 for scissors 95 is enclosed by mounting plate 67 and covering plate 68 in the direction of bottom side 78 and upper side 69. At the same time swivel plate 98 is mounted adjacent a corner area 91 of operational tools carrier 1 by a swivel peg 100 perpendicular to bottom side 78 shown in phantom in the drawing. Preferably, swivel peg 100 is cylindrical and is housed in a swivel seat or receptacle that is similarly shown in phantom. The swivel seat or receptacle is configured as a curved, connecting link pathway, for example. Swivel peg 100 can be secured against axial motion in swivel receptacle 101 by means of a retaining ring, and/or by being made directly from mounting plate 67 and/or covering plate 68.

Of course, retaining area 8, opening 35, and longitudinal areas 83, 85, 88, 93, 94 dedicated to operational tools 9 can, for example, be made from mounting plate 67, and/or from covering plate 68, and/or from an intermediate plate placed between them and not further shown in the drawings. Alternatively, various webs (not shown) may be provided to define areas 8, as disclosed in WO 97/19856 A and U.S. application Ser. No. 09/077,482.

Usefully, operational tools carrier 1 has an information carrier 56, preferably on mounting plate 67. Naturally, information carrier 56 can be placed on covering plate 68, and/or between mounting plate 67 and covering plate 68. In the present embodiment, exemplary information carrier 56 is made of a memory and/or a computer chip 58 that communicates with a state of the art control unit that is not further shown in the drawing. This communication of stored data, etc., to the external control unit takes place via transmissions over an interface arranged (but not shown) on operational tools carrier 1 and/or by means of wireless data signals, and is used to compare nominal values with actual values and to conduct corresponding analyses.

The interface dedicated to operational tools carrier 1 preferably is placed on cross side face 66, and/or on longitudinal side face 65, and/or on covering plate 68, and/or on mounting plate 67 and can communicate with a computer and/or control unit via interface lines that are not further shown in the drawings. Naturally, the computer and/or memory chip 58 can be mounted on any desired place of operational tools carrier 1 with its own dedicated interface, such as for example on covering plate 68, and/or on mounting plate 67, and/or on cross side face 66, and/or on longitudinal side face 65. The data signals, stored data, etc., are transmitted without wires, by means of radio waves or other energy field. Computer and/or memory chip 58 may be incorporated between mounting plate 67 and covering plate 68, and/or integrated in an intermediate plate placed between plates 67, 68 that remains protected against external damaging effects throughout its entire service life. This ensures a high reliability that the data, signals, stored information, etc., will be readable. A transparent, single-color and/or is variously colored material, as already described in detail in FIGS. 1 through 4, may be used to facilitate viewing of the computer and/or memory chip 58. Operational tools carrier 1 can also be equipped with several information carriers 56.

The total thickness 102 of operational tools carrier 1 of FIGS. 5-9 in relation to width 63 and length 64 has to be appropriately configured in order for operational tools carrier 1 to be manufactured in the form of a card, so that it can be inserted into the spaces used for ordinary credit cards and wallets, or the like. As to how these dimensions are determined, the detailed disclosures of WO 97/19856 A and U.S. application Ser. No. 09/077,482 that are directed to selection of such dimensions is incorporated by reference in its entirety.

In connection with the preceding, however, it also is important that the wall thickness 103 of the base 67 and covering plate 68 be kept as low (small) as possible. Given such a wall thickness 103, supporting and/or connecting slideways 106, 107, 108 (to name only a few) are arranged over an interior surface 104, 105 of the base plate 67 and covering plate 68 to form retention areas 8. The supporting and/or connecting slideways 106, 107, 108 provide sufficient strength, stability, and resistance to bending stresses and impact stresses (e.g., if the card falls down on a hard foundation), and to insure there will be no delaminating between base plate 67 and covering plate 68 under normal use.

Connecting tracks 109, 110 are arranged adjacent to the supporting and/or connecting slideways 106, 107, 108. The individual retention areas 8 for the operational tools 9 are separated by means of supporting and/or connecting slideways 106, 107, 108, as illustrated and described in detail with reference to FIGS. 5 and 6. The Disclosure to FIGS. 52 to 56 from WO 97/19856 A and U.S. application Ser. No. 09/077,482 regarding the detailed development of the supporting and/or connecting slideways 106, 107, 108, individual retention areas 8, and connecting tracks 109, 110 is incorporated herein by reference and reference is thus made to that disclosure for further details. As can be seen from FIGS. 7 to 9—using the same reference symbols used in FIGS. 5 and 6—the supporting and or connecting slideways 106 to 108 exhibit a greater height 111, starting from the interior surface 104, than connecting tracks 109 and 110 that jut out vertically over interior surface 104 for a smaller distance 112. Furthermore, connecting tracks 109, 110 also may exhibit a smaller width than supporting or connecting slideways 106 to 108. As can be appreciated more clearly with reference to FIG. 9, the total thickness 102 of the operational tools carrier 1 is comprised of the wall thickness 103 of the base and covering plate 67, 68, of the height 111 of the supporting and/or connecting slideways 106 to 108, and of the distance 112 of connecting tracks 109 and 110, when the two parts with their surfaces 104, 105 are smoothed down and put together one on top of the other. In such a case, when covering 68 and base plate 67 are placed on top of each other the sum total from the height 111 and the distance 112 is slightly larger than the inside height 113 between the two interior surfaces 104 and 105, after the operational tools carrier 101 is fully assembled. This difference in height is useful if the base plate 67 is connected to the covering plate 68 by ultrasonic welding, since pieces of material from connecting tracks 109, 110 and/or from supporting and/or connecting slideways 106, 107, 108 are melted by ultrasonic welding, until individual stopping faces on the opposing interior surfaces are flush with each other. If, on the other hand, base and covering plates 67, 68 are to be glued or pasted to each other, then such excess amounts of height 111 and distance 112 are not absolutely necessary. Rather, in this case the sum total of these deviations may be slightly smaller than interior height 113, to ensure that the adhesive layer is thick enough.

The operational tools carrier 1 is preferably made of a transparent, monotone or clear material, and/or from different colored materials.

To accommodate the high stresses on the material when using the operational tools carrier 1 and, on the other hand, to ensure mass production with minimal amounts of waste, it turns out, surprisingly, that amorphous polymers can be usefully employed to meet these requirements. This is true, even taking into account varying shrinkage, thin wall thickness, and unfavorable ratio of flow-path-wall thickness resulting from the latter. Pfropfcopolymers made of methacrylate-acrylonitrile-styrene-butadiene MABS and from styrene-butadiene (MBS) are such polymers, for example. These materials have the advantages of combining clear transparency with a high degree of strength and stability and good flowability. In addition, they evidence low susceptibility to stress cracking and good shock resistance and impact strength when notched. Furthermore, in their sum of all the required criteria, these materials represent a good compromise as regards all the required properties since, on the one hand, they are suitable for ultrasonic welding and, on the other, can be printed on. However, instead of the materials mentioned above, polycarbonate (PC) or styrene-butadiene (SB) or acrylnitrile styrene-butadiene (ABS) also could be used, for example. It must be noted that the last named materials only can be used in a transparent form after finely divided rubber phases have been mixed in. Beyond that, amorphous modified polyethylene terephthalate (PBT) or polybutylene terephthalate (PBT) also could be used.

The previously mentioned advantages are achieved by using the materials mentioned above. Above all, these materials also make it possible to keep shrinkage dimensions in the case of such low wall thickness and distinctly varying length and width ratios approximately equal in the direction of the injection and crosswise to it. This makes it possible to achieve a high degree of dimensional accuracy and to assemble separately manufactured parts with a high degree of precision. In addition, the materials cited above all show strong resistance against high-energy (ionizing) radiation, such as, for example, UV radiation, and the like. Of course, depending upon the use envisaged, any of the preceding materials can be mixed with each other in varying proportions and used for the purpose specified.

Surprisingly, thermal stress on components, for example from the effects of solar radiation, is reduced by the clear or transparent/translucent design of operational tools carrier 1, since radiation passes through the body of operational tool carrier 1, because of its highly absorbent color and transparency, and is absorbed by retaining frame 2 and/or by the background and/or side walls 18, 22. In this way the stress or pressure load on operational tools carrier 1 also is reduced, and the risk of delaminating is avoided.

Figure 11:
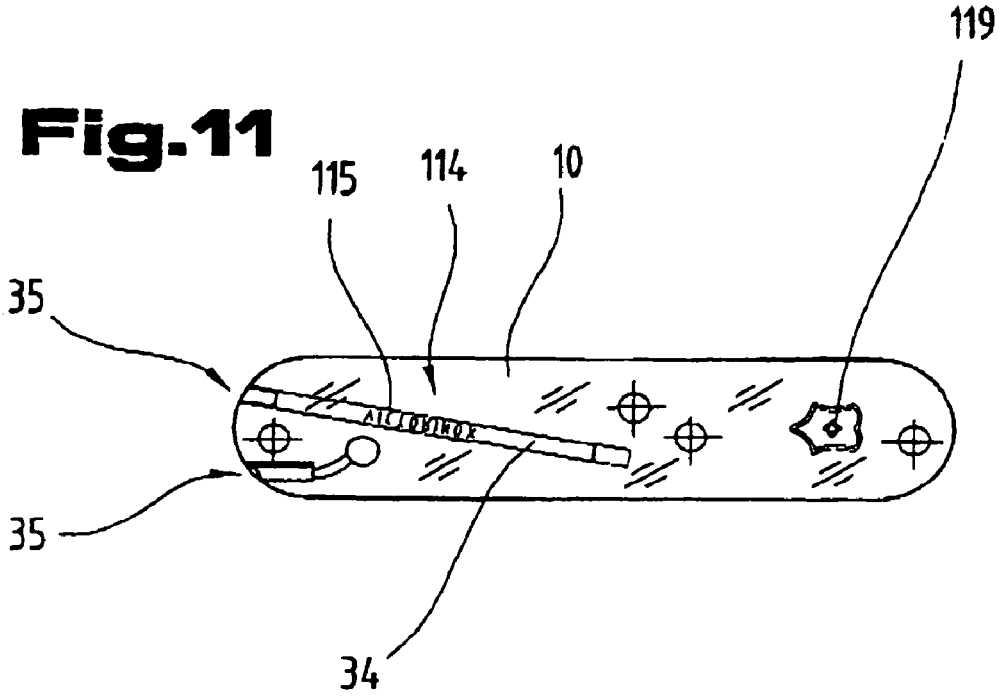
FIG. 11 is a plan view of the interior surface of the scale shown in FIG. 3.
Figure 10:
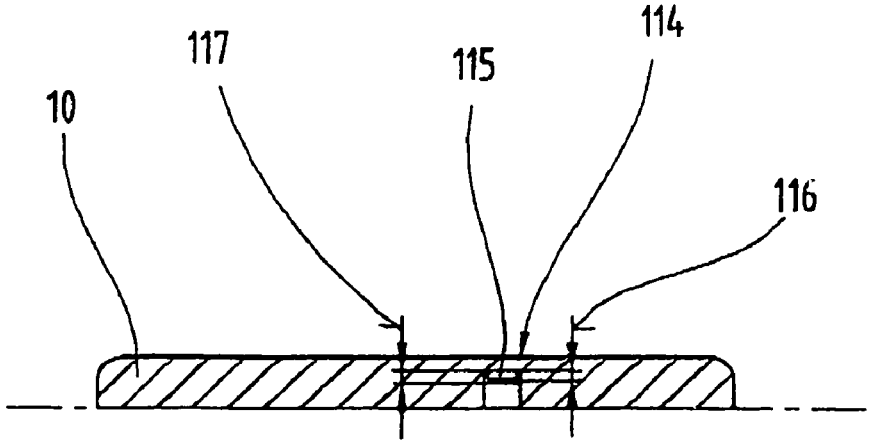
FIG. 10 is an enlarged view of a cross-section of the scale of FIG. 3 along lines X-X in FIG. 3.
Figure 12:
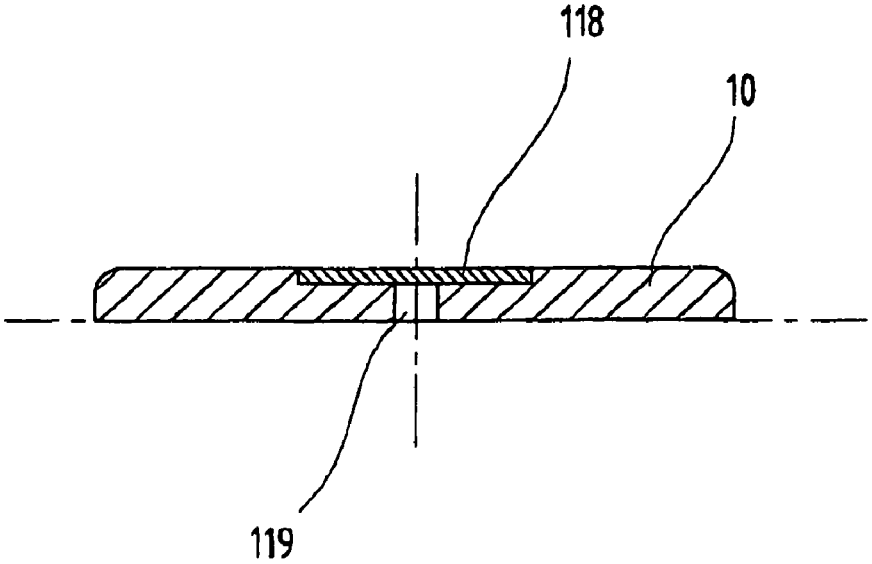
FIG. 12 is an enlarged view of a cross-section of the scale of FIG. 3 along lines XII-XII in FIG. 3.

FIGS. 10 to 12 present further detailed improvements of scales 10, as already described in the embodiment example in accordance with FIGS. 1 to 4. For this reason identical reference symbols are used for the same parts as were used in FIGS. 1 to 4.

If now, for example, an inscription or printing format 55, such as a corporate name, is supposed to be easily visible over a long period of time, a retention area 8—in retention area 33, for example—can be equipped with a recessed area 114 at least over a section of its length. Characters like letters 115 or numbers, for example, can be distributed over and laid out in recessed area 114. In such a case, height 116 of letter 115 may be the same as, or smaller than, the depth 117 of the recessed area 114. It also may prove to be useful, however, to make the height 116 of individual characters, such as letters 115, greater than the depth 117, for instance, so the operational tool 9 inserted into this retention area 33 is positioned and retained therein through increased friction in the area of the printing format 55 or inscription.

The background or side walls 18 or 22 also could be made matte or non-reflective on their surfaces so that, when inserting the operational tool 9, for example, if the tool is designed to be very shiny the design or printing format 55 only becomes visible, or distinctly visible, to the observer through the reflection of this inscription. Furthermore, a printing format 55 also could be applied on retention area 33, for example, whereupon different inscriptions could be applied on the opposite surfaces visible through scale 10 so that a different inscription can be seen from the outside, depending upon how the operational tool 9 is inserted into retention area 33.

Furthermore, however, as shown in FIG. 12, pre-formed machine parts 118 also can be put into the surface of at least one of the scales 10 level with exterior surface 40. This can be accomplished, for example, by inserting pre-formed machine parts 118 made of various materials, such as metal, plastic, wood, paper or the like, into position in the hollow of the mold before cutting the plastic to make scale 10, whereupon the plastic is then put in place in the hollow of the mold. In this way the pre-formed machine part can be embedded level in the surface of scale 10 and be molded or conformed to the scale 10 through the adhesive effect of the plasticizing synthetic material, so as to achieve a permanent and solid hold.

Furthermore, a borehole 119 also could be made in scale 10, through which the pre-formed machine part 118 can be kept in position in the hollow of the mold. Later, if the inserted part or pre-formed machine part 118 becomes damaged, it can be ejected through this borehole 119 and replaced with a new part squeezed in through the borehole.

Still again, however, the hollow for the pre-formed machine part 118, including borehole 119, also could be made in a pre-formed tool. The borehole then can be used so air can be released from the bottom of the hollow of the mold when inserting and squeezing a pre-formed machine part 118 that, for example, may be made of metal or a hard plastic. This will ensure a snug fit and engagement of the pre-formed machine part 118 in scale 10. Of course, recesses in the surface of scale 10 may also be designed so the pre-formed machine part 118 to be placed therein locks or snaps into place in this recess, and thus is interlocking, or has a positive fit.

Naturally, irrespective of the preceding, one can embed things in the surface of the scale using any state of the art connecting material, such as glue, ultrasonic welding, friction welding, or the like.

Additionally, it is useful if cellulose acetate is used as the material for scale 10. This material has the advantage of being thoroughly transparent. In consequence it only has to be pigmented with the appropriate colors if it is not supposed to be used clear. Beyond that, of course, it also is possible to make a scale 10 out of a polyamide PA.

Scale 10 also can be positioned on side walls 18 and 22 using snap-on connections and held in place by such means. One advantage of scales 10, and especially when scales 10 are made of transparent plastic material, is that the heat build-up of scales 10 from the penetration of heat and luminous radiation can be sharply reduced and the popping-off of scales 10 from long exposure to the effects of the sun can be reduced by extending the differential plastic material to the metal of one of the pocket knives.

It will be appreciated that the embodiment versions shown in FIGS. 1 to 4 also can be applied to the tool card described in FIGS. 5 to 9. Additionally, for the sake of accuracy and completeness, it should be noted that the operational tools carrier 1 or its components at times are not shown according to correct scale, and/or are enlarged and/or reduced in size, so as better to appreciate their construction. The aim underlying the independent, original solutions of the present invention may be deduced from the description and specifications. Above all, the individual embodiments shown in FIGS. 1 through 12 form the subject matter of independent, original solutions. The tasks and solutions relating to these embodiments may be deduced from the detailed descriptions and specifications of these Figures.

What is claimed is:

1. Plate-shaped plastic tool card having longitudinal side faces and cross side faces comprising:

a bottom plate having an interior surface;

a cover plate arranged parallel of said bottom plate, and having an interior surface;

a distributed array of support and connecting ridges extending across said interior surfaces of the base and cover plates of said tool card;

side ridges are formed on at least one of said base and cover plates adjacent and parallel to said longitudinal side faces of said tool card, said distributed array of support and connecting ridges being between said side ridges;

a plurality of retaining areas internally storing a plurality of operational tools, which areas are arranged in a plane running parallel to said bottom and cover plates, adjacent to one another and at least partly separated from one another by said support and connecting ridges, each of said operational tools being accessible via an opening and are retained in a storage position that holds said operational tools in form-fitting or frictional fashion; and wherein said bottom and cover plates as well as said support and connecting ridges are produced from transparent plastics material.

2. Plate-shaped plastic tool card as in claim 1, wherein retaining areas extend from a first cross side face toward a second cross side face of said tool card.

3. Plate-shaped plastic tool card as in claim 1, wherein at least one lighting device is arranged between said bottom and cover plates within said tool card.

4. Plate-shaped plastic tool card as in claim 1, wherein at least one memory chip is arranged between said bottom and cover plates within said tool card.

5. Plate-shaped plastic tool card as in claim 1, wherein at least one computer chip is arranged between said bottom and cover plates within said tool card.

* * * * *